United States Patent [19]

Kaibara et al.

[11] 4,366,796

[45] Jan. 4, 1983

[54] DISTRIBUTION TYPE FUEL INJECTION PUMP

[75] Inventors: Nobuhiro Kaibara, Higashi-Matsuyama; Masayoshi Kobayashi, Kawagoe, both of Japan

[73] Assignee: Diesel Kiki Co., Ltd., Tokyo, Japan

[21] Appl. No.: 221,909

[22] Filed: Dec. 31, 1980

Related U.S. Application Data

[62] Division of Ser. No. 920,627, Jun. 29, 1978, Pat. No. 4,271,806.

[30] Foreign Application Priority Data

Jun. 30, 1977 [JP] Japan ..... 52-77177
Jun. 30, 1977 [JP] Japan ..... 52-77178

[51] Int. Cl.[3] ..... F02M 59/20
[52] U.S. Cl. ..... 123/502; 123/501
[58] Field of Search ..... 123/502, 501; 417/462

[56] References Cited

U.S. PATENT DOCUMENTS

| | | | |
|---|---|---|---|
| 2,750,933 | 6/1956 | Lauck | 123/450 |
| 3,147,746 | 9/1964 | Hofer | 123/502 |
| 3,906,916 | 9/1975 | Laufer | 123/502 |
| 3,943,902 | 3/1976 | Skinner | 123/502 |
| 4,037,573 | 7/1977 | Swift | 123/502 |
| 4,122,813 | 10/1978 | Barnert et al. | 123/502 |
| 4,143,632 | 3/1979 | Kobayashi | 123/502 |
| 4,177,775 | 12/1979 | Hofer et al. | 123/502 |

*Primary Examiner*—Ira S. Lazarus
*Assistant Examiner*—Magdalen Moy
*Attorney, Agent, or Firm*—Birch, Stewart, Kolasch & Birch

[57] ABSTRACT

A distribution type fuel injection pump for use in a fuel injection combustion engine comprising a plunger capable of moving reciprocally along its axis and simultaneously rotating about its axis and a couple of members forming a cam mechanism having a first cam member and a second cam member. The first cam member is mounted on the plunger and the second cam member is mounted on a housing rotatably about its axis. The couple of cam members cause the plunger to reciprocally move while the plunger is rotating. The angular position of the second cam member about its axis can be controlled by a fuel injection timing control means in accordance with the engine speed. The second cam member can also turn about its axis so as to be adjusted in its angular position by a fuel injection timing adjustment when a selected operating condition of the engine, for example the engine start, is carried out.

12 Claims, 5 Drawing Figures

DISTRIBUTION TYPE FUEL INJECTION PUMP

This application is a divisional of copending application Ser. No. 920,627, filed on June 29, 1978, now U.S. Pat. No. 4,271,806.

BACKGROUND OF THE INVENTION

The present invention relates to a distribution type fuel injection pump for use in an internal combustion engine, such as a diesel engine.

In conventional distribution type fuel injection pumps wherein a plunger is mounted on a barrel so as to be capable of reciprocal axial movement to suck and to pressurize a fuel and rotate about its axis to distribute the pressurized fuel to each combustion chamber of the engine, an injection timing apparatus (so called engine speed timer) is disposed. The injection timing apparatus automatically advances the injection timing in accordance with increase of engine revolutions, i.e. engine speed.

On the other hand, in an injection type internal combustion engine, such as a diesel engine, in order to easily start the engine, it is necessary to advance the injection timing at the time of the engine starting operation. That requirement is more important in a cold engine condition. According to the afore-going conventional engine speed timer, however, since the engine speed is very slow at the engine's start, no starting advance of the injection timing can be obtained. Therefore, a required starting advance has heretofore been attained by means of a manual operation mechanism mounted separately from the automatic engine speed timer and hence, this operation is very troublesome.

SUMMARY OF THE INVENTION

An object of the present invention is to provide a distribution type fuel injection pump capable of automatically advancing the injection timing at the time of the engine starting operation.

Another object of the present invention is to provide a distribution type fuel injection pump capable of automatically advancing the injection timing at the time of the engine starting operation in cold conditions.

A further object of the present invention is to provide a distribution type fuel injection pump capable of automatically advancing the injection timing from the start of an engine in a cold condition up to the establishment of a warmed-up engine.

According to the present invention, there is provided a fuel injection pump for use in a fuel injection combustion engine, comprising:

a housing having a fuel chamber therein; a plunger movably mounted on said housing and forming a plunger chamber over a head of the plunger; first cam means fixedly mounted on the plunger; second cam means turnably mounted on the housing and cooperating with the first cam means so as to cause reciprocal motion of the plunger along the axis thereof during plunger rotation with respect to the second cam means, the second cam means being capable of taking one of a plurality of angular positions thereof; fuel supply means for introducing fuel into the plunger at the suction stroke of the plunger; a delivery port for feeding fuel to the engine from the plunger chamber at the delivery stroke of the plunger; a leak port formed in the plunger and connected to the plunger chamber; a control sleeve slidably mounted on the plunger for normally closing the leak port and for connecting the leak port to the fuel chamber at the end of the delivery stroke to terminate the fuel injection; a governor device actuating the control sleeve for controlling the quantity of fuel to be injected; injection timing control means for controlling the angular position of the second cam means in response to the engine speed; and, injection timing adjusting means for providing an adjusted movement of the second cam means toward a predetermined angular position under a preselected operating condition of the engine at the low engine speed range.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
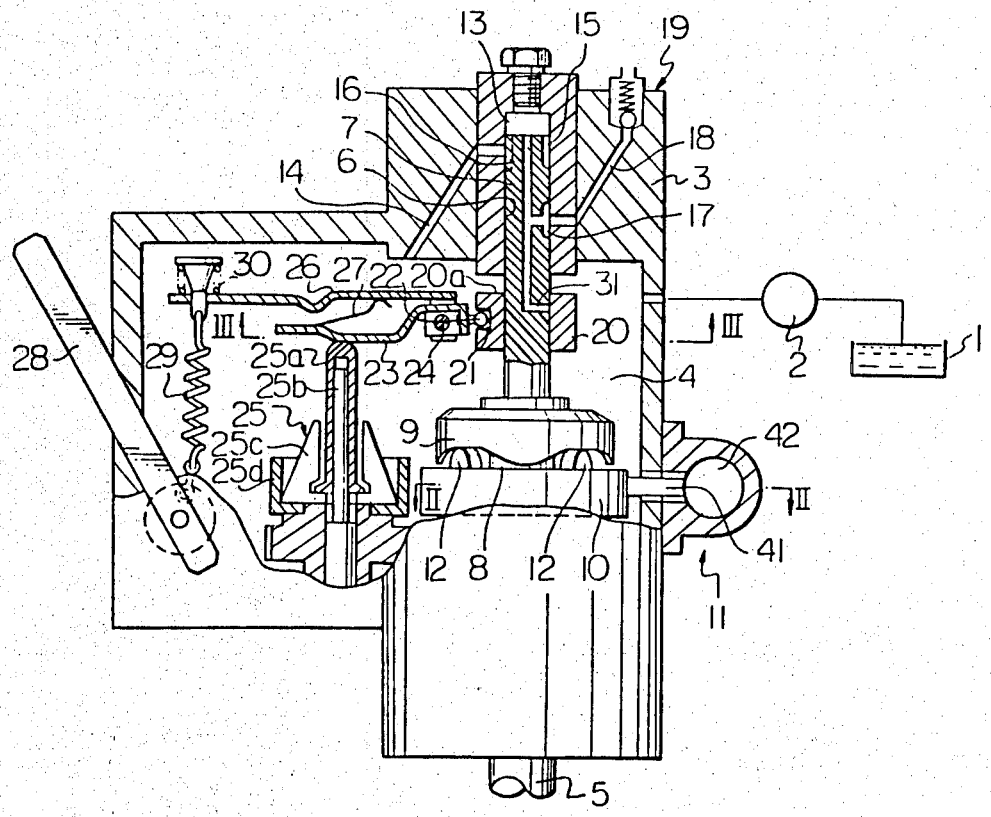
FIG. 1 is a cross-sectional side view of a fuel injection pump according to the present invention.
Figure 2:
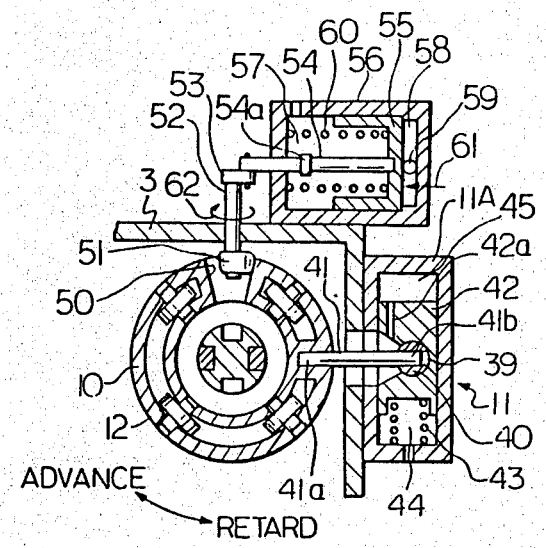
FIG. 2 is a cross-sectional view taken along the line II—II in FIG. 1.

Referring to FIGS. 1 and 2, fuel is sucked from a fuel tank 1 by means of a fuel pump 2 and then fed into a fuel chamber 4 formed in a pump housing 3. As is known to those skilled in the art, since the delivery pressure of the fuel pump 2 is increased in accordance with increase in the number of engine revolution i.e. the engine speed, the fuel pressure in the fuel chamber 4 is increased in accordance with increase in the engine speed.

A pump plunger 7 is movably inserted into a barrel 6 formed in the pump housing 3 and, as is hereinafter described, this pump plunger 7 is rotated about its axis and reciprocally axially moved up and down. In FIG. 1, reference numeral 5 designates a drive shaft which is driven by an engine and the lower end 8 of the plunger 7 is engaged with the upper end of the drive shaft 5 so that the plunger 7 rotates together with the drive shaft 5 and in addition, the plunger 7 moves up and down relative to the drive shaft 5. A cam disc 9 is fixed onto the plunger 7 and, thus, the cam disc 9 rotates together with the plunger 7. This cam disc 9 has on its lower end a circular cam face which forms a plurality of projections. In this embodiment, the number of these projections corresponds to that of combustion chambers of the engine. A roller holder 10 is arranged beneath the cam disc 9 in the fuel chamber 4 and rotated by means of a piston-cylinder mechanism 11 (FIG. 2) which serves to advance the injection timing in accordance with increase in the pressure within the fuel chamber 4, that is, in the engine speed. The piston-cylinder mechanism 11 will be hereinafter explained in detail. The roller holder 10 has a plurality of rollers 12 which are always in contact with the circular cam face of the cam disc 9 so as to cause the plunger 7 to move upwards when the peaks of the circular cam face of the cam disc 9 move on the rollers. Consequently, when the drive shaft 5 is driven, the plunger 7 reciprocally moves up and down while, at the same time, rotating about its axis.

At the time of the suction stroke of the plunger 7, that is, when the plunger 7 moves downward in FIG. 1, fuel is fed into a plunger chamber 13 of the barrel 6 from the fuel chamber 4 via a fuel feed port 14 formed in the pump housing 3 and via one of a plurality of longitudinal grooves 15 formed on the outer periphery of the top portion of the plunger 7.

On the other hand, in the delivery stroke of the plunger 7, the longitudinal groove 15 is disconnected from the fuel feed port 14 immediately after the upward movement of the plunger 7 is started. When the plunger 7 further moves upwards, the fuel in the plunger chamber 13 is fed into one of distribution ports 18 via a central bore 16 and a transverse bore 17 and then fed into the fuel injector (not shown) via a check valve 19. Thus, the injecting operation is carried out.

As illustrated in FIG. 1, a control sleeve 20 is slidably mounted on the plunger 7. A circumferential groove 21 is formed on the outer peripheral surface of the control sleeve 20, and one end 22 of a lever 23 which is pivotably mounted on the pivot pin 24 is fitted into the circumferential groove 21. The other end of the lever 23 is arranged to always engage with a centrifugal governor 25 so that the lever 23 is actuated by the centrifugal governor 25. The centrifugal governor 25 is a known type engine speed governor as illustrated below. The lever 23 faces the operation and of a centrifugal governor sleeve 25*a*, and this sleeve 25*a* is moved in the axial direction on a sliding shaft 25*b* by a fly-weight 25*c*. The fly-weight 25*c* is mounted on a pocket member 25*d* which is driven by the engine. Accordingly, the fly-weight 25*c* is moved outwardly in the radial direction basing on the centrifugal force in correspondence to the engine speed by the pocket member 25*d* then the centrifugal force is transmitted to the lever 23 so as to shift the lever 23 upwardly. Namely, with increase of the engine speed, the lever 23 is turned around the pin 24 in the clockwise direction as shown in FIG. 1 to bring down the control sleeve 20. In addition, one end of a tension lever 26 is pivotably mounted on the pivot pin 24, and the lever 23 is resiliently engaged with the tension layer 26 via a start spring 27. Furthermore, a control lever 28, which is connected to the acceleration pedal (not shown), is connected to one end of the tension lever 26 via a main spring 27 and an idle spring 30.

FIG. 1 shows the moment when an engine is started. At this time, as is illustrated in FIG. 1, the control sleeve 20 is positioned at its uppermost position. Once an engine is started, the speed of same is gradually increased and then, an engine is operated under an idling condition slightly after an engine is started. At this time, the control sleeve 20 moves down to a slight extent from its uppermost position shown in FIG. 1 due to the upward movement of the centrifugal governor 25. As is illustrated in FIG. 1, another transverse bore 31 which is in communication with the central bore 16 is formed in the middle portion of the plunger 7 so that the other transverse bore 31 is closed by the cylindrical inner wall of the control sleeve 20 when the plunger 7 is positioned at its lower position. As mentioned above, fuel in the plunger chamber 13 is gradually fed into the distribution port 18 as the plunger 7 moves upwards. When the plunger 7 approaches its uppermost position, the transverse bore 31 moves upwards beyond the upper surface 20*a* of the control sleeve 20 and opens into the fuel chamber 4. At this time, the fuel under pressure in the plunger chamber 13 is discharged into the fuel chamber 4 via the center bore 16 and the transverse bore 31 and as a result, the injecting operation of fuel is stopped. As mentioned above, the control sleeve 20 is positioned at its uppermost position at the moment the engine is started. In addition, the control sleeve 20 moves downwards as the number of engine revolutions is increased. Consequently, from FIG. 1, it will be understood that, as the number of engine revolutions is increased, the terminal moment of the fuel injection is advanced, that is, the amount of fuel injected into the cylinders of an engine is reduced.

A first embodiment of the injection timing control mechanism of the present invention, which can advance the injection timing automatically at the engine starting where the piston-cylinder mechanism 11 never advance the injection timing because of the low engine speed, will now be described by reference to FIG. 2.

The roller holder 10 is disposed in the housing 3 so that it can rotate concentrically with the drive shaft 2. One end 41*a* of a lever 41 is fixedly connected to a peripheral outer portion of the roller holder 10, and the other end 41*b* of the lever 41 is slidably fitted in a bore 39 formed in a ball 40 which is rotatably joined with a piston 42. A chamber 44 containing a spring 43 therein and a pressure chamber 45, in which the pressurized fuel in the fuel chamber 4 is introduced via a passage 42*a* formed in the piston, are disposed in a cylinder 11A at both ends of the piston 42, respectively. Namely, the position of the piston 42 is determined depending on the relation between the force of spring 43 effected against the piston and the hydraulic pressure of the fuel according to the engine speed also effected on the opposite side face of the piston. Therefore the position of the roller holder 10 with respect to the circumferential direction is determined depending on the relation through the lever 41. The change of the position of the roller holder 10 with respect to the circumferential direction results in a change of the position of contact between the roller 11 and the cam face of the cam disc 9. As a result, the moment when the peaks of the cam face of the cam disc 9 are engaged with the rollers to move the plunger 7 upwardly, i.e. in the delivery stroke, is changed with reference to the rotating angle of the plunger, that is a crank angle of the engine, and therefore, the injection timing can be changed relative to the crank angle. Incidentally, in the above arrangement, when the piston 42 is moved downward as shown in FIG. 2 against the force of the spring 43 by the hydraulic pressure, the roller holder 10 is turned in the clockwise direction to advance the injection timing.

A recess 50 is formed on an upper surface of the roller holder 10 and an eccentric cam 51 mounted on one end of a shaft 52 rotatably supported in the housing 3 is engaged with the opposite side faces of the recess 50. An arm 53 is attached to the other end of the shaft 52 at its one end and is pivotally connected to a rod 54 of a piston 55 at its other end. The piston 55 is slidably fitted in a cylinder house 56. An atmospheric pressure chamber 57 and a compressed fuel chamber 58, which communicates with the fuel chamber 4 via a fuel passage 59, are formed in the cylinder housing 56 at both ends of the piston 55, respectively. A spring 60 disposed in the atmospheric pressure chamber 57 acts with resilient force on the piston 55 so as to urge said piston 55 toward the compressed fuel chamber 58 (in the opposite direction to the direction indicated by an arrow 61 in the drawing), and the hydraulic pressure introduced into the fuel chamber 58 acts on the piston 55 in the direction indicated by the arrow 61. The opposite direction to the direction indicated by arrow 61 illustrates the direction of advancing the injection timing.

In the first embodiment having the above-mentioned structure, the hydraulic pressure introduced into the compressed fuel chamber 58 changes in direct proportion to the speed of the engine. Accordingly, the hydraulic pressure is low at the starting of the engine and hence, the piston 55 is shifted to the advancing direction (the opposite direction to the direction shown by the arrow 61) by the elastic force of the spring 60. Thus, the displacement of the piston 55 in the linear direction is converted to a displacement of the shaft 52 in the rotary direction (the opposite direction to the direction shown by an arrow 62) through the rod 54 and the arm 53. As a result, a peak face of the eccentric cam 51 turns to engage with one side face of the recess 50 formed on the roller holder 10 and then turns the roller holder 10 in the clockwise direction which is the direction of advancing the injection timing. In this state, the low pressure fuel is also introduced into the pressure chamber 45 of the piston-cylinder mechanism 11. However, as the resilient force of the spring 43 is superior to the force of the fuel pressure effected on the spring in the chamber 45, the resilient force is apt to cause the piston to shift in the direction of the chamber 45 and therefore, rotate the roller holder 10 via the rod 41 in the direction of retarding of the injection timing. Consequently, it is necessary to design or pre-set the pressure receiving area of both pistons 42,55, the load of the springs 43,60 and the length of the arm 53 so that the force of the piston 55 causing the rotation of the eccentric cam 51 engaged with the side face of the recess 50 is sufficient enough for causing rotation of the roller holder 10 in the direction of advancing of the injection timing against the force exerted by the piston 42. The relationship between the injection timing and the engine speed is shown as a line M in FIG. 3.

When the engine speed is elevated to a level corresponding to the idle rotation after starting and the hydraulic pressure is proportionally elevated by the elevated hydraulic pressure, the piston 55 is caused to move in the retarding direction until the stopper 54*a* of the rod 54 comes in contact with the wall of the atmospheric pressure chamber 57. Accordingly, the shaft 52 is rotated in the direction shown by the arrow 62 via the arm 53 to turn the eccentric cam 51 so as to contact the side face of the recess 50 at a lower cam face thereof. As a result, the roller holder 10 effected by the piston 42 to rotate in the retarding direction as explained above, is permitted to rotate in the direction of retarding of the injection timing with acceptance of restricting the rotation by means of the eccentric cam 51. This characteristic is shown as a line N in FIG. 3.

When the engine speed is increased beyond the predetermined level, the hydraulic pressure in the chamber 45 is also increased and pushes the piston 42 against the elasticity of the spring 43 to rotate the roller holder 10 in the clockwise direction, that is, the direction advancing the injection timing in accordance with the increase of the engine speed. Consequently, the characteristic of controlling the injection timing is similar to that of a conventional-type injection timing control device which is understood as a device without the starting injection timing adjusting device comprising the piston 55, eccentric cam 51 etc. and is shown as a line P in FIG. 3.

As will be apparent from the foregoing illustration, the injection timing is advanced to some extent at the starting to obtain a starting advance and this advancing operation is gradually retarded by utilizing the increase of the hydraulic pressure before the idling engine speed is attained.

A second embodiment of the injection timing control mechanism of the present invention will now be described with reference to FIG. 4.

Figure 3:
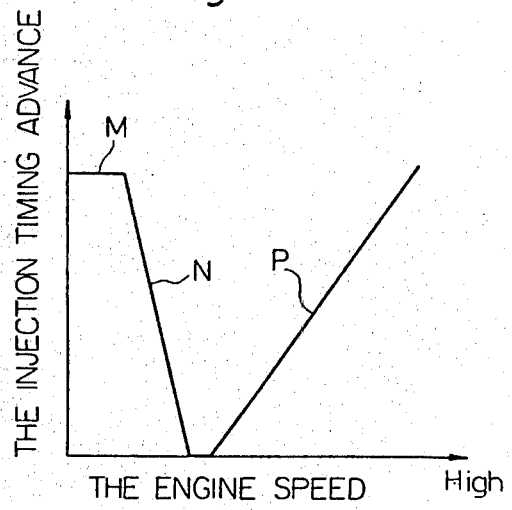
FIG. 3 is a diagram illustrating the relationship between an engine speed and an injection timing according to the embodiment shown in FIGS. 1 and 2.
Figure 4:
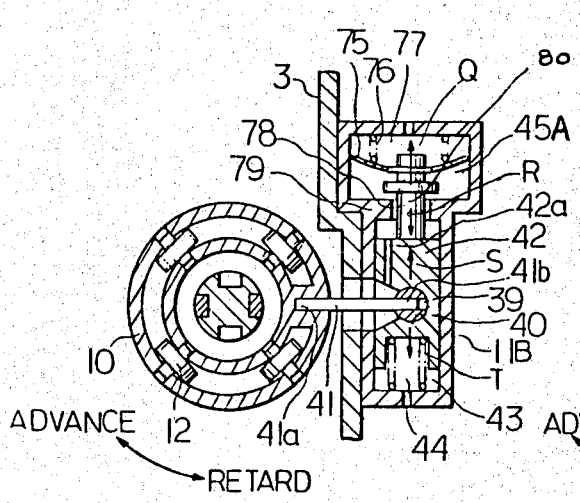
FIG. 4 is a cross-sectional view of another embodiment of an injection time control mechanism, which is a modification of that shown in FIG. 2, of a fuel injection pump according to the present invention.

Referring to FIG. 4, the present embodiment is different from the conventional structure, which is shown, for example, with the structure of the above-mentioned starting injection timing adjusting device deleted from the injection timing control device shown in FIG. 3, in the following points.

A part of the inner wall of the compressed fuel chamber 45A (45 in FIG. 2) is formed by a metallic plate 75 which is flexible and expandable and an atmospheric chamber 77 containing a spring 76 is formed on the back of the flexible plate 75. A rod 78 is fixed to the central portion of the flexible plate 75 so that the front end of the rod 78 confronts the piston 42. The above arrangement is made so that the relation of $(f/a)>(F/A)$ is established, in which a stands for a set load of the spring 43, A stands for a pressure-receiving area of the flexible plate 75, which is larger than the pressure-receiving area a of the piston 42, and F stands for a set load of the spring 76, which is larger than the set load f of the spring 43.

Accordingly, when the hydraulic pressure P in accordance with the engine speed is lower than (F/A) at the starting, since F is larger than AP and f is larger than aP, if the relation of $F-PA>f-Pa$ is established at this point, the rod 78 can be moved to the position regulated by the engagement of stopper 79 formed on the inner surface of the compressed fuel chamber 45A and the projection 80 formed on a peripheral surface of the rod 78 by the flexible plate 75 shifted in the direction of an arrow designated by R by the elasticity of the spring 76. The piston is then caused by the rod 78 to move in the direction of an arrow T, namely in the advancing direction, against the spring 43. Thus, the roller holder 10 is turned in the clockwise direction through the rod 41 to advance the injection timing.

When the engine speed is increased to a level corresponding to the idling speed after the starting and the hydraulic pressure is proportionally increased to establish the relation of $f/a>P>(F/A)$, since F is smaller than AP and f is larger than aP, the flexible plate 75 is displaced in the direction of an arrow Q, namely in the direction away from the piston 42, by the action of the hydraulic pressure, and finally, the rear end of the rod 78 comes in contact with the upper inner face of housing 11B. Otherwise, the piston 42 is moved in the direction shown by an arrow S following the movement of the rod 78 since the elasticity of the spring 43 is predominant over the force effected on the face of the piston 42 by the hydraulic pressure of the fuel. Therefore, the roller holder 10 is turned in the counterclockwise direction and the above-described starting advance is thus released.

If the rotation number is further increased, by the increase of the hydraulic pressure P owing to the increase of the rotation number, the piston 42 is gradually moved in the direction shown by an arrow T to be taken out of contact with the rod 78 while maintaining a balance with the resilient force of the spring 43. In short, the piston 42 is operated in the advancing direction and performs the same function as that of the conventional engine speed timer. In the present embodiment, the relation between the engine speed and the injection timing-adjusting angle is changed as shown in FIG. 2.

In the present embodiment, it is in order to reduce the sliding resistance and increase the pressure-receiving area so that the metallic flexible plate 75 can be used as the compressed fuel chamber. In the present invention, however, any other hydraulic pressure-responding members such as a piston may be used instead of the metallic flexible plate 75.

A third embodiment of the injection timing adjustment apparatus of the present invention will now be described with reference to FIG. 5.

Figure 5:
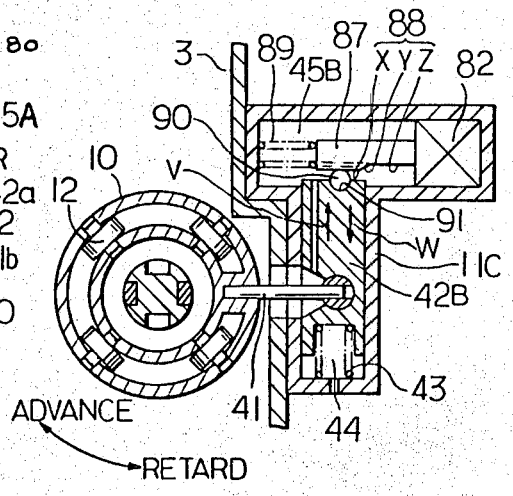
FIG. 5 is a cross-sectional view of a further embodiment of an injection time control mechanism, modifying that shown in FIGS. 2 and 4, of a fuel injection pump according to the present invention.

Referring to FIG. 5, the present embodiment is different from the conventional structure as is apparent from the fore-going explanation in the following points.

A pressure chamber 45B is formed on the side of the piston 42B opposite the atmospheric pressure chamber 44. The chamber 45B contains therein a wax pellet actuator 82 capable of expanding or contracting slidably in response to engine temperature, for example, the temperature of a cooling water for cooling the engine, a rod 87 connected to the wax pellet actuator 82 and a return spring 89 for contracting the wax pellet actuator 82. A cam portion 88 on the side face of the rod 87 is disposed to bear against the piston 42B through a roller 90 which is turnably received in a recess 91 formed on the end of the piston 42B.

In the third embodiment having the above-mentioned structure, while the engine temperature (cooling water temperature) is in the range of from −30° to 0° C., the face X of the cam portion 88 is caused to bear against the piston 42B through the roller 90, whereby the piston 42B is moved in the advancing direction (in the direction indicated by an arrow W in the drawing) against the elastic force of the spring 43. Thus, the roller holder 10 is turned through the rod 41 to advance the injection timing and therefore, the starting under cold conditions can be facilitated.

When the engine temperature is elevated after the starting, because of the resulting expansion of the wax pellet of the actuator 82, the rod 87 is moved leftward in FIG. 5 and the face Y (inclined face) of the cam portion 88 comes in contact with the piston 42B through the roller 90. At this point, the piston 42B is gradually shifted in the retarding direction shown by an arrow V by means of the elasticity of the spring 43. When the engine temperature is further elevated and arrives at a level of 60° to 80° C. to complete the engine warming up operation, the wax pellet of the actuator 82 is further expanded and the face Z of the cam portion 88 is caused to bear against the piston 42B through the roller 90 and the piston 42B is set at the retarding position.

Accordingly, the normal injection timing adjustment for advancing in accordance with the engine speed is restored, since the hydraulic pressure of the fuel introduced into the chamber 45B is increased beyond the level where the hydraulic pressure effects the piston 42B which pressure is superior to the elasticity of the spring 43.

The expansion or contraction displacement of the wax pellet of the actuator 82 may be directly imposed on the roller holder 10. However, if the piston 42B connected to the roller holder 10 is caused to make a stroking movement by the cam portion 88 of the rod 87 as in the above-mentioned third embodiment, an optional advance characteristic to the engine temperature can be obtained by changing the configuration and shape of the cam portion 88.

Further, an operation fluid having a high coefficient of thermal expansion may be used and sealed instead of the thermowax.

The foregoing embodiments may also be applied to an overflow type pump where the quantity of the fuel to be injected is determined based on the quantity of the excessive fuel discharged. Moreover, the embodiments may be applied to a pump of the throttle amount adjustment type.

Still further, as will be apparent to those skilled in the art, the present invention may be applied to a distributor type fuel injection pump of the type where a pair of plungers is disposed on the side portion of a cylindrical distributor driven and rotated by the engine, each plunger is rotated on the inner circumferential cam face of a cam ring surrounding the plunger through a roller interposed between the cam ring and the suction and compression feeding of the fuel is accomplished by the resulting reciprocative movement of each plunger. In this case, the concept of the injection timing adjustment of the present invention is applied to the timer of the pump which controls the injection timing by displacing the above-mentioned cam ring in the circumferential direction.

As will be apparent from the foregoing illustration, according to the present invention, a preferred injection timing characteristic can be obtained according to the rotation number of the engine and injection timing can be automatically advanced at the starting. Therefore, the present invention makes great contributions to improvements in the starting characteristics in diesel engines and the like. Further, since the injection timing can be automatically advanced at the starting, the starting operation can be remarkably facilitated and the injection pump of the present invention can be conveniently utilized in many types of vehicles, such as automobiles, trucks, buses etc.

What is claimed is:

1. A fuel injection pump for use in a fuel injection combustion engine, comprising:

a housing having a fuel chamber therein;

a plunger movably mounted on said housing and forming a plunger chamber over a head of said plunger;

first cam means fixedly mounted on said plunger;

second cam means turnably mounted on said housing and cooperating with said first cam means so as to cause reciprocal motion of said plunger along the axis thereof during plunger rotation with respect to said second cam means, said second cam means being capable of being positioned in one of a plurality of angular positions thereof;

fuel supply means for introducing fuel into said plunger at the suction stroke of said plunger;

a delivery port for feeding fuel to the engine from said plunger chamber at the delivery stroke of said plunger;

a leak port formed in said plunger and connected to said plunger chamber;

a control sleeve slidably mounted on said plunger for normally closing said leak port and for connecting said leak port to said fuel chamber at the end of the delivery stroke to terminate the fuel injection;

a governor device actuating said control sleeve for controlling the quantity of fuel to be injected;

injection timing control means for controlling the angular position of said second cam means in response to the engine speed; and injection timing adjusting means for providing an adjusted movement of said second cam means toward a predetermined angular position to advance the injection timing at the engine start;

said injection timing adjusting means comprising a second cylinder mounted on said housing, a second piston slidably positioned in said cylinder, a second pressure chamber formed by said housing and a head portion of said piston, a second spring urging said piston towards said second pressure chamber, an eccentric cam engageable with a side face of a recess formed on said second cam means whereby the engagement of a peak portion of said eccentric cam and the side face of said recess imparts a motion to said cam means to turn towards a predetermined angular position where the injection timing is advanced, and a link mechanism connecting said second piston to said eccentric cam for transferring the movement of said second piston to turn said eccentric cam , said second piston being moved in accordance with the difference between the elasticity of said second piston and the hydraulic pressure in said pressure chamber.

2. A fuel injection pump for use in a fuel injection combustion engine, comprising:

a housing having a fuel chamber therein;

a plunger movably mounted in said housing and forming a plunger chamber over a head of said plunger;

first cam means fixedly mounted on said plunger;

second cam means turnably mounted on said housing and cooperating with said first cam means so as to cause reciprocal motion of said plunger along the axis thereof during plunger rotation with respect to said cam means, said second cam means being capable of being positioned in one of a plurality of angular positions thereof;

fuel supply means for introducing fuel into said plunger at the suction stroke of said plunger;

a delivery port for feeding fuel to the engine from said plunger chamber at the delivery stroke of said plunger;

a leak port formed in said plunger and connected to said plunger chamber;

a control sleeve slidably mounted on said plunger for normally closing said leak port and for connecting said leak port to said fuel chamber at the end of the delivery stroke to terminate the fuel injection;

a governor device actuating said control sleeve for controlling the quantity of fuel to be injected;

injection timing control means for controlling the angular position of said second cam means in response to the engine speed so as to displace said second cam means to advance the injection timing in response to an increase in engine speed;

said injection timing control means comprising a first piston slidably fitted into a first cylinder and connected to said second cam means via a first rod, said first piston being urged by elasticity of a first spring to urge said second cam means toward injection timing retarding and said first piston being effected by hydraulic pressure of fuel, in response to the engine speed, introduced into a first pressure chamber to move said second cam means towards injection timing advancing against said elasticity of said spring, said first piston moving in accordance with the difference between said elasticity and said pressure in said pressure chamber, said first piston being provided with a fuel passage therethrough for communicating said first pressure chamber with said fuel chamber in said housing, said fuel passage being in communication with said fuel chamber through said housing; and injection timing adjusting means for providing an adjusted movement of said second cam means toward a predetermined angular position to advance the injection timing at the engine start, said injection timing adjusting means comprising a second cylinder mounted on said housing, a second piston slidably positioned in said cylinder, a second pressure chamber formed by said housing and a head portion of said piston, a second spring urging said piston toward said second pressure chamber, an eccentric cam engageable with a side face of a recess formed on said second cam means whereby the engagement of a peak portion of said eccentric cam and the side face of said recess imparts a motion to said cam means to turn towards a predetermined angular position where the injection timing is advanced, and a link mechanism connecting said second piston to said eccentric cam for transferring the movement of said second piston to turn said eccentric cam, said second piston being moved in accordance with the difference between the elasticity of said second piston and the hydraulic pressure in said pressure chamber.

3. A fuel injection pump according to claim 1 or 2, wherein said injection timing adjustment means adjusts the angular position of said second cam means toward a predetermined angular position so as to advance the injection timing at the engine start in cold conditions.

4. A fuel injection pump according to claim 1 or 2, wherein said first rod is connected to said first piston through a ball rotatably positioned within a bore formed in said first piston.

5. A fuel injection pump according to claim 1 or 2, wherein said second piston being in communication with said second pressure chamber on one side thereof and being in communication with the atmosphere on the other side thereof.

6. A fuel injection pump according to claim 1 or 2, wherein said second pressure chamber is in communication with said fuel supply means.

7. A fuel injection pump according to claim 1 or 2, wherein said link mechanism includes a stop member to limit reciprocation of said second piston.

8. A fuel injection pump for use in a fuel injection combustion engine, comprising:

a housing having a fuel chamber therein;

a plunger movably mounted on said housing and forming a plunger chamber over a head of said plunger;

first cam means fixedly mounted on said plunger;

second cam means turnably mounted on said housing and cooperating with said first cam means so as to cause reciprocal motion of said plunger along the axis thereof during plunger rotation with respect to said second cam means, said second cam means being capable of taking one of a plurality of angular positions thereof;

fuel supply means for introducing fuel into said plunger at the suction stroke of said plunger;

a delivery port for feeding fuel to the engine from said plunger chamber at the delivery stroke of said plunger;

a leak port formed in said plunger and connected to said plunger chamber;

a control sleeve slidably mounted on said plunger for normally closing said leak port and for connecting said leak port to said fuel chamber at the end of the delivery stroke to terminate the fuel injection;

a governor device actuating said control sleeve for controlling the quantity of fuel to be injected;

injection timing control means for controlling the angular position of said second cam means in response to the engine speed; and injection timing adjusting means for providing an adjusted movement of said second cam means toward a predetermined angular position to advance the injection timing at the engine start;

said injection timing adjusting means comprises a second cylinder mounted on said housing, a second piston slidably fitted into said cylinder, a second pressure chamber in said housing facing a head of said piston, a second spring urging said piston toward said second pressure chamber, an eccentric cam engageable with a side face of a recess formed on said second cam means, by the engagement between the peak of said eccentric cam and the side face of said recess, said second cam means being adjusted to turn toward a predetermined angular position where the injection timing is advanced, and a link mechanism connecting said second piston to said eccentric cam for transferring the movement of said second piston to turn said eccentric cam, said second piston moving in accordance with the difference between the elasticity of said second piston and the hydraulic pressure in said pressure chamber.

9. A fuel injection pump according to claim 8, wherein said first rod is connected to said first piston through a ball rotatably positioned within a bore formed in said first piston.

10. A fuel injection pump according to claim 8, wherein said second piston being in communication with said second pressure chamber on one side thereof and being in communication with the atmosphere on the other side thereof.

11. A fuel injection pump according to claim 8, wherein said second pressure chamber is in communication with said fuel supply means.

12. A fuel injection pump according to claim 8, wherein said link mechanism includes a stop member to limit reciprocation of said second piston.

* * * * *